US007341338B2

(12) United States Patent
Uwagaki et al.

(10) Patent No.: US 7,341,338 B2
(45) Date of Patent: Mar. 11, 2008

(54) INKJET PRINTER

(75) Inventors: Hideo Uwagaki, Kyoto (JP); Nobuyuki Nakamura, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 70 days.

(21) Appl. No.: 10/571,272

(22) PCT Filed: Sep. 9, 2004

(86) PCT No.: PCT/JP2004/013104

§ 371 (c)(1),
(2), (4) Date: Mar. 9, 2006

(87) PCT Pub. No.: WO2005/030625

PCT Pub. Date: Apr. 7, 2005

(65) Prior Publication Data

US 2006/0290762 A1 Dec. 28, 2006

(30) Foreign Application Priority Data

Sep. 10, 2003 (JP) ..... 2003-318570

(51) Int. Cl.
*B41J 2/01* (2006.01)
*B41J 13/02* (2006.01)

(52) U.S. Cl. ..... 347/104; 400/636; 400/636.3

(58) Field of Classification Search ..... 347/104; 400/636, 636.3, 637, 637.1, 641
See application file for complete search history.

(56) References Cited

U.S. PATENT DOCUMENTS 6,712,463 B2 * 3/2004 Matsumoto ..... 347/104
2002/0171727 A1 * 11/2002 Kida et al. ..... 347/104
2003/0210315 A1 * 11/2003 Uwagaki et al. ..... 347/104

FOREIGN PATENT DOCUMENTS

| | | | |
|---|---|---|---|
| JP | 05-186086 A | | 7/1993 |
| JP | 07-033279 A | | 2/1995 |
| JP | 11-079461 A | | 3/1999 |
| JP | 11208923 | * | 3/1999 |
| JP | 11-208923 A | | 8/1999 |
| JP | 2002-114400 A | | 4/2002 |
| JP | 02002179319 | * | 6/2002 |
| JP | 02002326755 | * | 11/2002 |

* cited by examiner

*Primary Examiner*—Matthew Luu
*Assistant Examiner*—Joshua M Dubnow
(74) *Attorney, Agent, or Firm*—Birch, Stewart, Kolasch & Birch, LLP

(57) ABSTRACT

An inkjet printer includes a single transport roller (4), two first driven rollers (A: A1, A2), two first driven rollers (B: B1, B2), and a single first driven roller (C). The rollers (A1, A2, B1, B2, C) are rotatably held by holders (8*a* to 8*e*) at respective downstream ends thereof. The holders (8*a* to 8*e*) are aligned with one another along a fast scanning direction and are rotatably supported at upstream ends thereof by a support shaft (81). The holders (8*a* to 8*e*), the shaft (81), and a plurality of springs (9) are assembled into a holder assembly (8). The holder assembly (8) has the shaft (81) fixed to a main frame (1). The springs (9) are fixed at one end to respective middle portions of the holders (8*a* to 8*e*), and at the other end to the frame (1).

5 Claims, 6 Drawing Sheets

INKJET PRINTER

BACKGROUND OF THE INVENTION

1. Field of the Invention

The present invention relates to inkjet printers adapted to eject ink drops onto a sheet for an image to be formed thereon while the sheet is being transported.

2. Description of the Related Art

FIG. 3 is a perspective view of a conventional inkjet printer, and FIG. 4 is a schematic side view of the same. As shown in FIGS. 3 and 4, a sheet is picked up and fed by a not shown pick-up roller, nipped between a transport roller 4' and a plurality of driven rollers A', and transported a predetermined distance leftward in FIG. 4, i.e., in a slow scanning direction. An inkjet print head 22 is held by a carriage positioned downstream of the roller 4' in the slow scanning direction. While being reciprocated in a fast scanning direction and an opposite fast scanning direction, the head 22 ejects ink drops onto a sheet. The fast and opposite fast scanning directions are perpendicular to the slow scanning direction. The printer performs an image forming process in a sequence of alternating transport of sheet in the slow scanning direction and reciprocation of the head 22 in the fast and opposite fast scanning directions. The printer stops the reciprocation of the head 22 when a not shown sheet sensor detects a tailing end of a sheet being about to pass through a nip area between the roller 4' and the rollers A'. The sheet is finally nipped between output rollers 5' and output driven rollers 7', to be ejected from the printer. The foregoing arrangement has the following problem. A distance X between the position of nozzles of the head 22 and the location of the nip area causes a blank space in a tailing end of sheet where no image is formed. In other words, the tailing end has a limited image area.

Some conventional inkjet printers allow an image to be formed up to a tailing edge of sheet without leaving a blank space in such mechanical methods as of: transporting a sheet at a low speed during duration of image formation on a tailing end of the sheet; increasing nip pressure applied to a sheet by output rollers in order to reduce a change in load on a sheet caused at the moment a tailing end of the sheet is released from transport rollers; providing a mechanism for reducing backlash in a drive system for transport rollers with springs; or improving dimensional accuracy of components such as rollers. Also provided with complicated inkjet control system designed for high-quality image formation, the conventional printers have problems of complicated control of image formation and increased component costs. With regard to a leading end of the sheet, the sheet undergoes a change in load thereon the moment the leading end is nipped between the rollers 5' and 7', as with the tailing end. The change in load leads to improper transport of the sheet, thereby causing image deterioration such as color unevenness. Conventionally, the output driven rollers 7' are generally aligned with one another along the fast scanning direction. The moment a leading end of sheet is nipped between the rollers 7' and the roller 5', thus, the rollers 7' simultaneously apply pressure to the leading end, thereby causing a negative effect on sheet transport precision. The sheet transport precision decreases at higher pressures of the rollers 7'.

FIGS. 5 and 6 are views illustrating configuration of another conventional inkjet printer provided as a solution to the problems. The printer has driven rollers A', B', and C' arranged at three different locations along the slow scanning direction. Thus, there are three locations of nip areas between a transport roller 14 and the rollers A', B', and C'. The single roller C' is arranged in the center along the fast scanning direction. The two rollers A' are positioned symmetrically with respect to the roller C', and so are the two rollers B'. Five holders 18 are provided for holding the respective rollers A', B', and C' rotatably. The holders 18, which are respectively paired with the rollers A', B', and C', have respective springs 19 for urging the rollers A', B', and C' against the roller 14.

The arrangement allows pressures applied to a sheet by the rollers A' to C' to be decreased, from upstream to downstream, sequentially in three steps when a tailing end of the sheet is released from the three nip areas. Thus, the arrangement results in a reduced change in load on the sheet the moment the sheet is released from pressures between the roller 14 and the rollers A', B', and C'. The reduced change in load means less negative effect on sheet transport precision and better image quality. The printer is otherwise similar in component and operation to the first conventional printer as shown in FIGS. 3 and 4.

In order to prevent improper image formation in a tailing end of sheet, there have also been proposed inkjet printers provided with driven rollers of flexible and hard materials aligned in two lines along the slow scanning direction, or provided with an auxiliary member, of various materials or shapes, that is located downstream of driven rollers and adapted to apply pressure to a sheet (see Patent Literature 1). Further, there have been proposed inkjet printers that are adapted to control pressures applied by driven rollers to a sheet so that the pressures can be almost or entirely eliminated (see Patent Literature 2 and 3). p [Patent Literature 1] JP H05-186086A p [Patent Literature 2] JP H07-033279A p [Patent Literature 3] JP H11-208923A

SUMMARY OF THE INVENTION

The conventional inkjet printer as shown in FIGS. 5 and 6, however, has the driven rollers A', B', and C' supported with the respective holders 18 and mounted separately to a main frame 1. Referring to FIG. 6, there are a distance Y1' of approximately 0.2 mm between the rollers A' and B' and a distance Y2 of approximately 1.0 mm between the rollers B' and C'. Accordingly, positioning accuracy of the rollers A', B', and C' and the roller 4 is greatly affected by: dimension error such as of dimension of a rotation shaft of each of the holders 18; dimension of location at which each of the driven rollers is mounted on a shaft of corresponding holder 18; or dimension of location at which each of the holders 18 is mounted to the frame 1. Fluctuations in position of the rollers A', B', and C' lead to changes in nip pressure between the roller 14' and the rollers A', B', and C', thereby largely affecting sheet transport conditions and changes in load on a sheet. High accuracy is required for dimension, and mounting location dimension, of each component. As described above, the conventional printer as shown in FIGS. 5 and 6 has the separate holders 18 arranged along the fast scanning direction. The arrangement potentially causes the driven rollers to be misaligned with one another. The arrangement also causes complicated component assembly work and increased manufacturing costs.

In light of the foregoing problems, a feature of the invention is to provide an inkjet printer that has a plurality of driven rollers assembled into a single component while nip pressures between the driven rollers and a transport roller are individually adjustable. The inkjet printer eliminates the need for work for mounting the driven rollers and prevents complicated assembly work and increased manufacturing costs, while ensuring high quality image.

An inkjet printer of the invention includes:

a first transport roller driven in a direction for transporting a sheet;

a plurality of first driven rollers adapted to press a sheet against the first transport roller in such a manner that the sheet is nipped between the first driven rollers and the first transport roller;

a second transport roller driven in the direction, the second transport roller being positioned downstream of the first transport roller in a sheet transporting direction;

a plurality of second driven rollers adapted to press a sheet against the second transport roller in such a manner that the sheet is nipped between the second driven rollers and the second transport roller;

an inkjet print head adapted to eject ink drops on a sheet while being reciprocated along a perpendicular direction to the sheet transporting direction, the inkjet print head being positioned between the first transport roller and the second transport roller; and a holder assembly including:

a plurality of holders for mounting the respective first driven rollers in such a manner that the first driven rollers are supported individually rotatably at different locations along the perpendicular direction while being arranged in different groups of one or more on different lines parallel to the perpendicular direction;

a support for supporting the holders; and a plurality of urging members for urging the respective first driven rollers against the first transport roller through the respective holders.

The configuration as described above allows the holders to be assembled through the support into a single component, and enables the first driven rollers to be individually urged by the respective urging members. The first driven rollers are assembled into a single component while nip pressures between the driven rollers and a transport roller are individually adjustable. The configuration allows precise arrangement of the first driven rollers along the sheet transport direction, while eliminating the need for work of simultaneously mounting the first driven rollers and adjusting the individual nip pressures. Thus, the configuration prevents complicated assembly work and increased manufacturing costs, while ensuring high quality image.

According to an aspect of the invention, the urging members are adapted to urge a more downstream one of the groups in the sheet transporting direction against the first transport roller with a weaker total force.

The configuration as described above allows a more downstream one of the groups of first driven rollers in the sheet transporting direction to be urged against the first transport roller with a weaker total force. Thus, the configuration allows a change in load on a sheet to be gradually smaller as a tailing end of the sheet proceeds through respective nip areas between the first driven rollers and the first transport roller, thereby ensuring smoother sheet transport in the course of the tailing end proceeding through the nip areas.

According to another aspect of the invention, the second driven rollers are arranged at different locations along the sheet transporting direction, and more than one of the second driven rollers are arranged most upstream in the sheet transport direction so as to be aligned with one another along the perpendicular direction.

The configuration as described above causes nip areas between the second transport roller and the second driven rollers, which are both positioned downstream of the inkjet print head in the sheet transport direction, to be formed at different locations along the sheet transporting direction. Thus, the configuration allows an increasing pressure to be applied to a sheet as a leading end thereof proceeds through the second transport roller and the second driven rollers. The configuration prevents a major change in load on a sheet, thereby allowing smooth sheet transport, in the course of the leading end proceeding through the nip areas.

According to another aspect of the invention, the most upstream second driven rollers are urged against the second transport roller with weakest total force.

The configuration as described above causes the most upstream second driven rollers to be urged against the second transport roller with weakest total force. The configuration prevents a major change in load on a sheet when a leading end of a sheet proceeds through a first one of the nip areas between the second transport roller and the second driven rollers, thereby allowing smoother sheet transport in the course of a tailing end proceeding through the first transport roller and the first driven rollers.

The invention provides advantages as presented below.

The holders are assembled through the support into a single component, so that the first driven rollers are individually urged by the respective urging members. The first driven rollers are assembled into a single component while nip pressures between the driven rollers and a transport roller are individually adjustable. Thus, the first driven rollers are precisely arranged along the sheet transport direction, while the need is eliminated for work of simultaneously mounting the first driven rollers and adjusting the individual nip pressures. Complicated assembly work and increased manufacturing costs are thus prevented, while high quality image is ensured. Also, a more downstream one of the first driven rollers in the sheet transporting direction is urged against the first transport roller with a weaker force. Thus, a change in load on a sheet becomes smaller as a tailing end of the sheet proceeds through respective nip areas between the first driven rollers and the first transport roller. Smoother sheet transport is ensured in the course of the tailing end proceeding through the nip areas.

Further, nip areas between the second transport roller and the second driven rollers, which are both positioned downstream of the inkjet print head in the sheet transport direction, are formed at different locations along the sheet transporting direction. This allows an increasing pressure to be applied to a sheet as a leading end thereof proceeds through the second transport roller and the second driven rollers. A major change in load on a sheet is prevented, and thus smooth sheet transport is allowed, in the course of the leading end proceeding through the nip areas.

Furthermore, the most upstream second driven rollers are urged against the second transport roller with weakest force in total. This prevents a major change in load on a sheet when a leading end of a sheet proceeds through a first one of the nip areas between the second transport roller and the second driven rollers. Thus, smoother sheet transport is allowed in the course of a tailing end proceeding through the first transport roller and the first driven rollers.

DETAILED DESCRIPTION OF THE INVENTION

Figure 1:
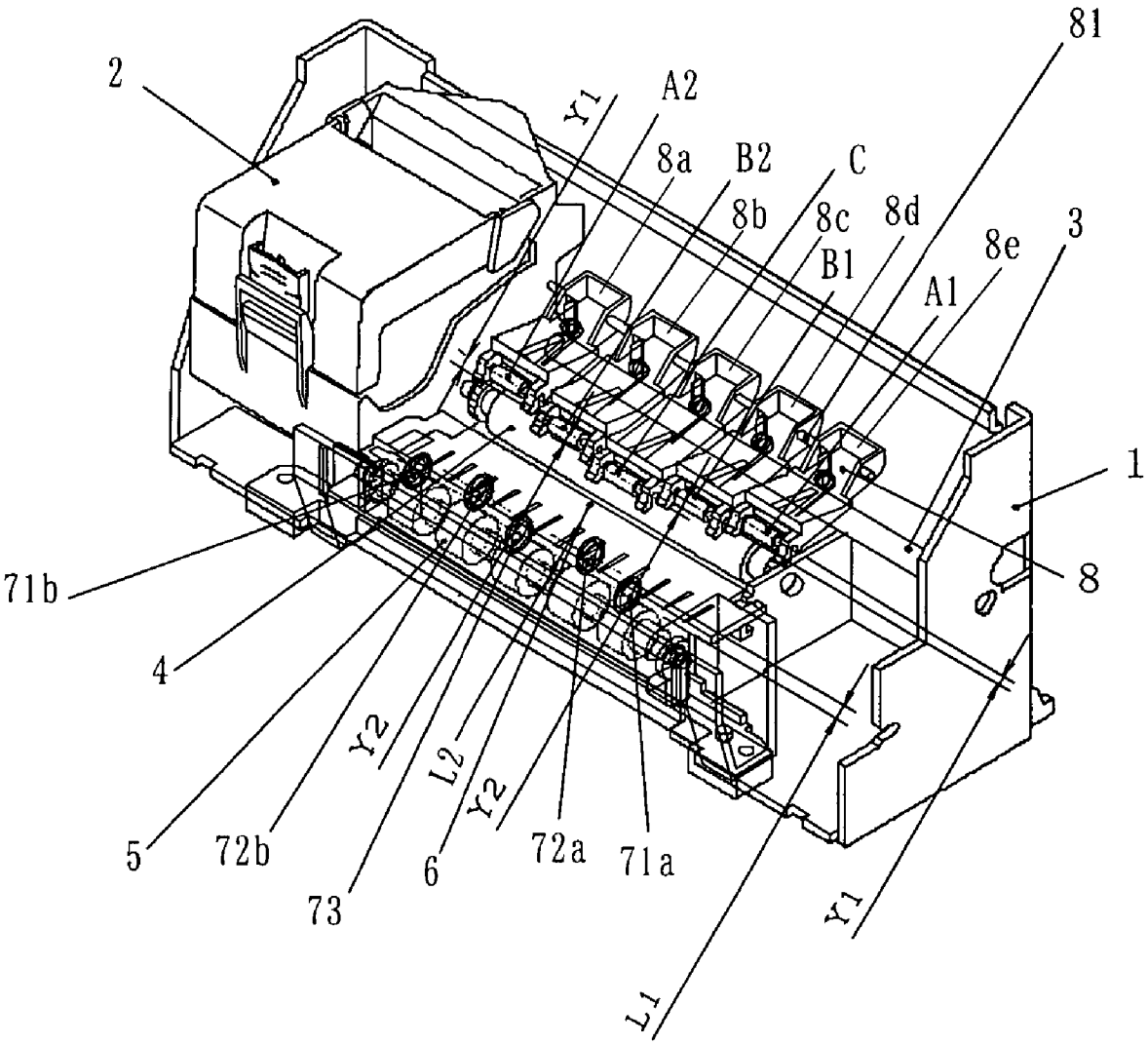
FIG. 1 is a perspective view of an inkjet printer according to an embodiment of the invention.

FIG. 1 is a perspective view of an inkjet printer according to an embodiment of the invention.

Figure 2:
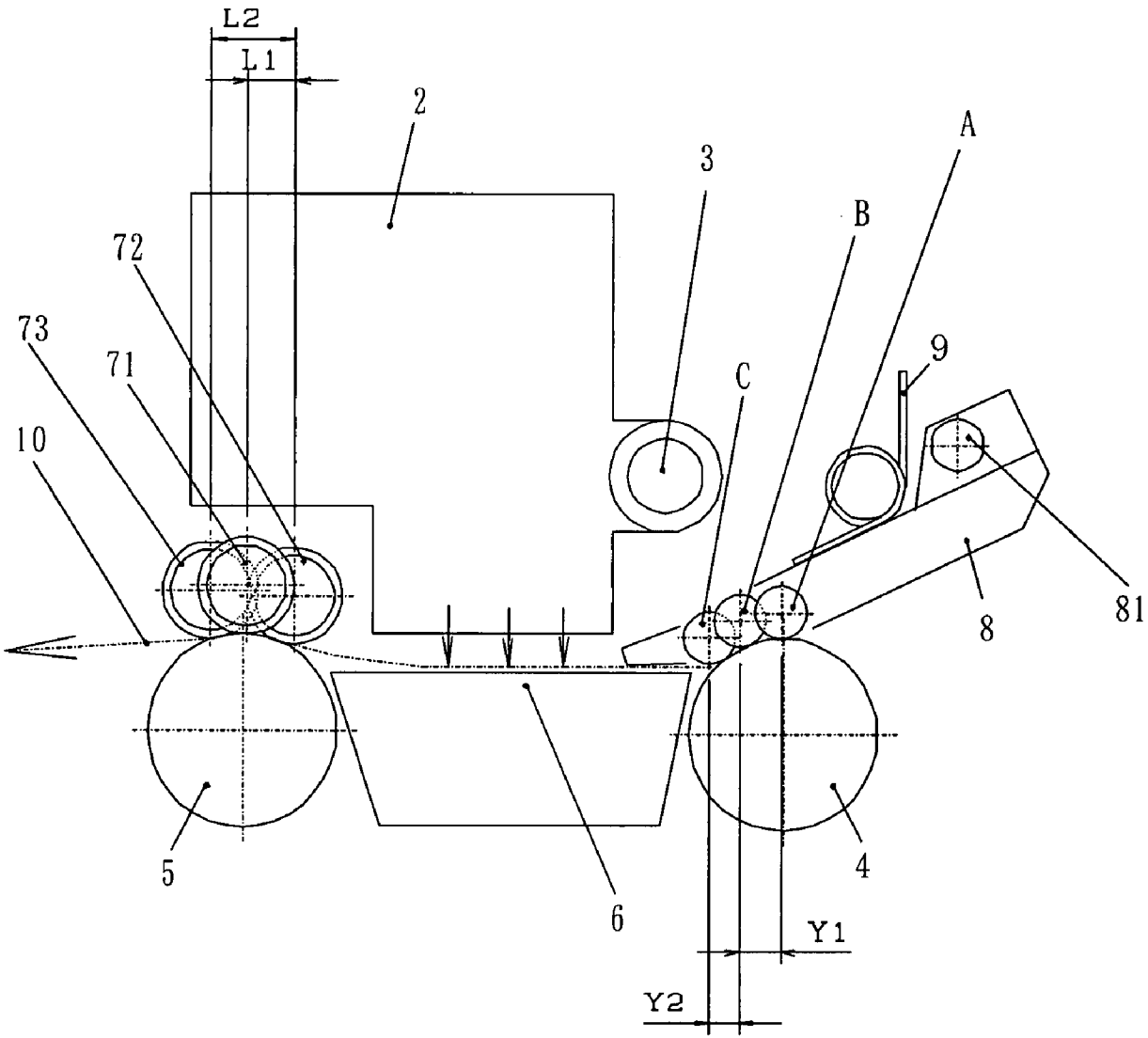
FIG. 2 is a schematic side view of the inkjet printer.
Figure 3:
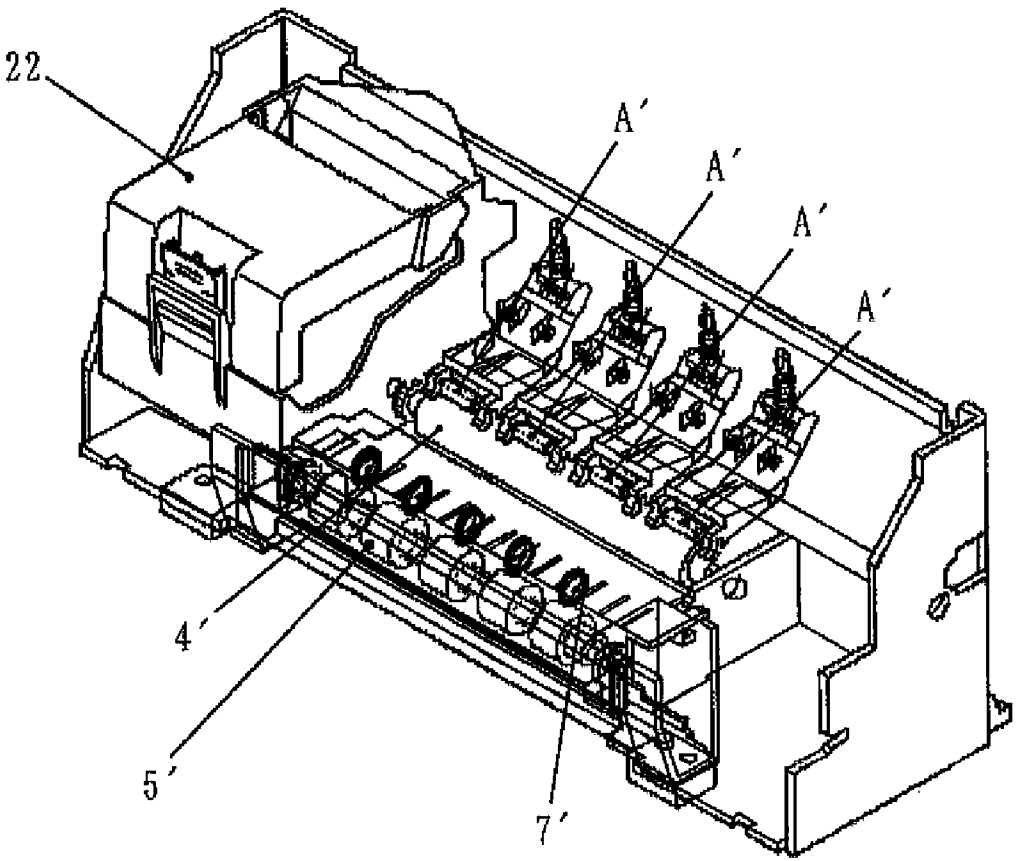
FIG. 3 PRIOR ART
FIG. 3 is a perspective view of a first conventional inkjet printer.
Figure 4:
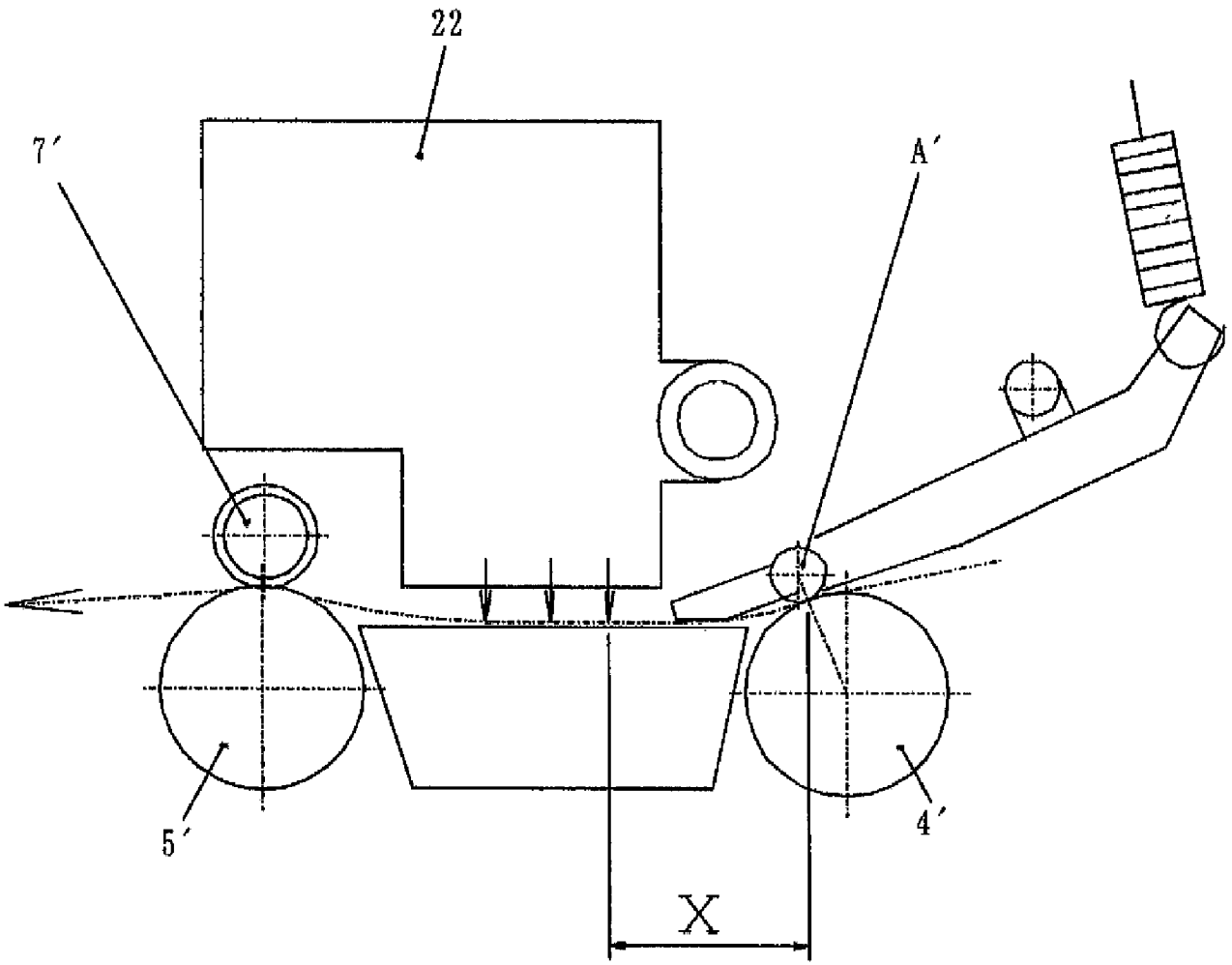
FIG. 4 PRIOR ART
FIG. 4 is a schematic side view of the first conventional inkjet printer.
Figure 5:
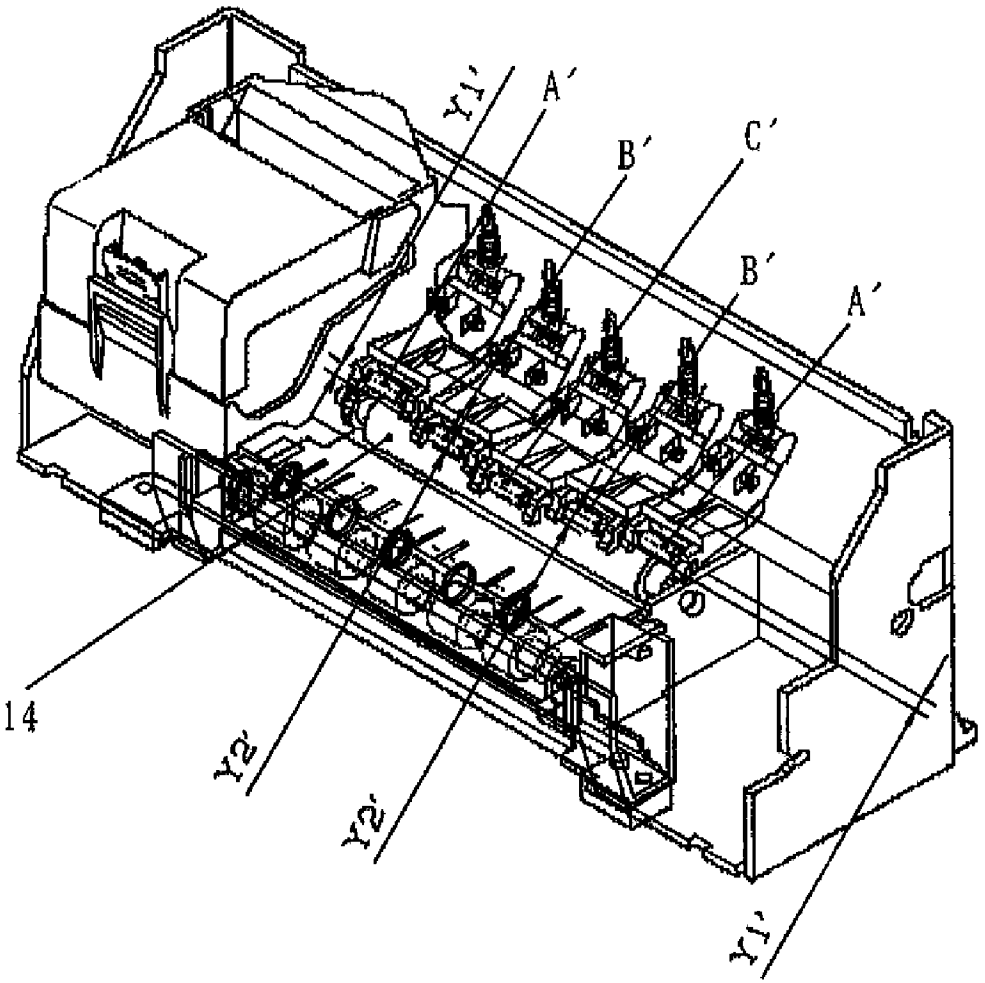
FIG. 5 PRIOR ART
FIG. 5 is a perspective view of a second conventional inkjet printer.
Figure 6:
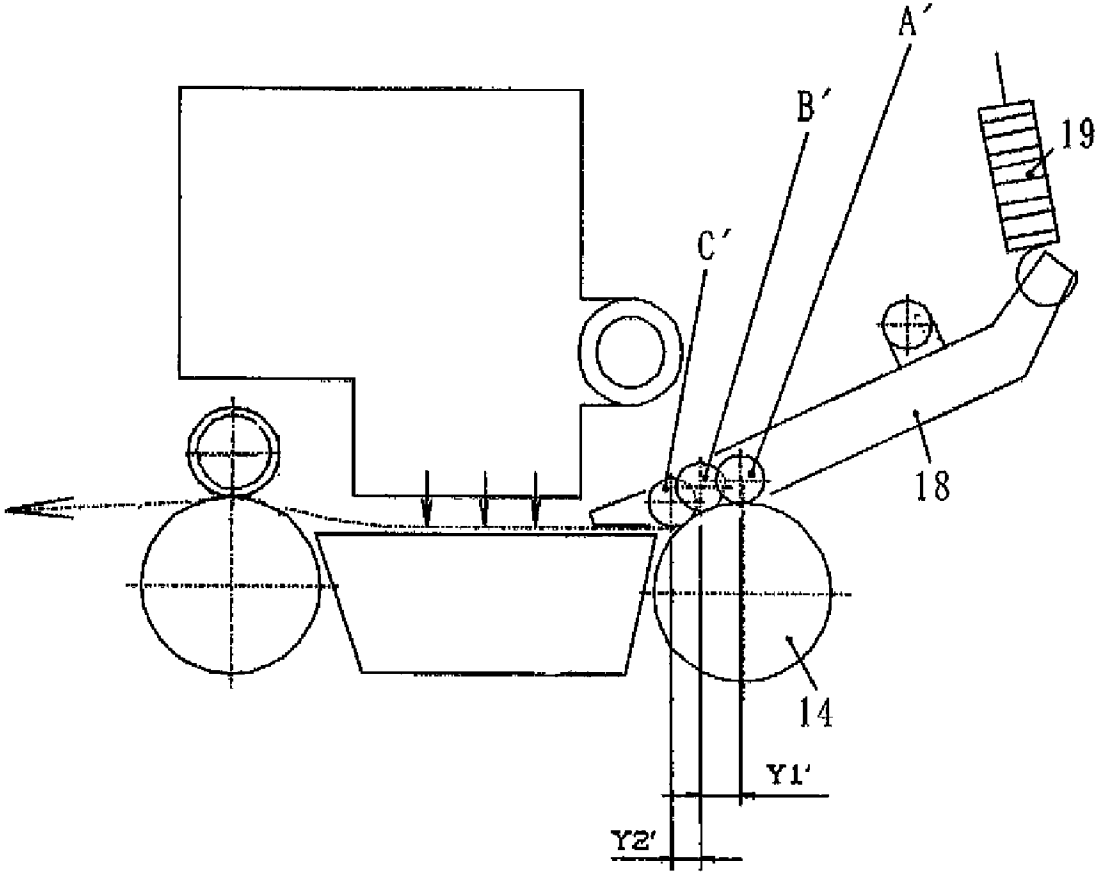
FIG. 6 PRIOR ART
FIG. 6 is a schematic side view of the second conventional inkjet printer.

FIG. 2 is a schematic side view of relevant part of the inkjet printer. Referring to FIG. 2, a sheet 10 is fed leftward in the figure, i.e., in a slow scanning direction, by rotation of a not shown pick-up roller. The pick-up roller is driven by a driving motor and a set of driving gears, both not shown.

Then, the sheet 10 is nipped between a first transport roller 4 and first driven rollers A to C as pressed against the roller 4, and thereby transported by a predetermined distance downstream to an image forming area that is located below an inkjet print head 2. The inkjet print head 2 is held, and reciprocated in a fast scanning direction and an opposite fast scanning direction, by a carriage. The fast and opposite fast scanning directions are perpendicular to the slow scanning direction. During the reciprocation, the inkjet print head 2 ejects ink drops onto the sheet 10 in the image forming area, thereby forming an image on the sheet 10.

A transport guide 6 is positioned opposite the inkjet print head 2. The transport guide 6 is adapted to position the sheet 10 in the image forming area at a constant vertical distance from the inkjet print head 2.

After a sequence of alternating transport of sheet in the slow scanning direction and reciprocation of the head 2 in the fast and opposite fast scanning directions, the sheet 10 is finally nipped between a second transport roller 5 and second driven rollers 71, 72, and 73, and ejected from the printer.

For the single transport roller 4, two first driven rollers A (A1 and A2), two first driven rollers B (B1 and B2), and a single first driven roller C are provided, from upstream to downstream, on three respective lines parallel to the fast scanning direction. The first driven rollers A1, A2, B1, B2, and C are rotatably held by holders 8*a* to 8*e* at respective downstream ends thereof. The holders 8*a* to 8*e* are aligned with one another along the fast scanning direction and are rotatably supported at upstream ends thereof by a support shaft 81. The holders 8*a* to 8*e*, the support shaft 81, and a plurality of springs 9 to be described below, are assembled into a holder assembly 8. The holder assembly 8 has the support shaft 81 fixed to a main frame 1. The springs 9 are fixed at one end to respective middle portions of the holders 8*a* to 8*e*, and at the other end to the main frame 1. The springs 9 correspond to the urging members of the invention. Through the holders 8*a* to 8*e*, the springs 9 urge the first driven rollers A1, A2, B1, B2, and C, respectively, against the first transport roller 4.

In the present embodiment, the five springs 9 are provided along the fast scanning direction, correspondingly to the first driven rollers A1, A2, B1, B2, and C. Alternatively, three urging members may be provided, one for each of the pair of first driven rollers A (A1, A2), the pair of first driven rollers B (B1, B2), and the single first driven roller C. More specifically, holders 8'*a*, 8'*b*, and 8'*c* may be provided for holding the pair of first driven rollers A (A1, A2), the pair of first driven rollers B (B1, B2), and the single first driven roller C, respectively, and three springs 9 may be fixed at one end to the respective holders 8*a*' to 8'*c*. In either alternative, the first driven rollers A1 and A2 are urged at equal forces, and so are the first driven rollers B1 and B2.

It is to be noted that the urging members include, but are not limited to, the springs 9 and that any device suffice as long as such device serves to urge the first driven rollers A to C against the first transport roller 4.

Areas of contact between the first transport roller 4 and the respective first driven rollers A to C, hereinafter referred to as the first nip areas, vary in location along the slow scanning direction. Along the fast scanning direction, the first nip areas are located approximately symmetrically with respect to a central line of the sheet 10 parallel to the slow scanning direction. Of the first driven rollers A to C, more specifically, the rollers A1 and A2 are positioned most upstream in the slow scanning direction and approximately symmetrical with respect to the central line. The rollers B1 and B2 are positioned midstream in the slow scanning direction and approximately symmetrical with respect to the central line. And the single first driven roller C is positioned most downstream in the slow scanning direction and on the central line.

Downstream of the inkjet print head 2 in the slow scanning direction, in the meanwhile, two second driven rollers 71 (71*a* and 71*b*), two second driven rollers 72 (72*a* and 72*b*), and a single second driven roller 73 are provided for the single second transport roller 5. The second driven rollers 71, 72, and 73 vary in location along the slow scanning direction. Most upstream, the two second driven rollers 72 are located along the fast scanning direction. Accordingly, areas of contact between the second transport roller 5 and the respective second driven rollers 71 to 73, hereinafter referred to as the second nip areas, vary in location along the slow scanning direction. Along the fast scanning direction, the second nip areas are located approximately symmetrically with respect to a central line of the sheet 10 parallel to the slow scanning direction. Of the second driven rollers 71 to 73, more specifically, the rollers 72*a* and 72*b* are positioned most upstream in the slow scanning direction and approximately symmetrical with respect to the central line. The rollers 71*a* and 71*b* are positioned midstream in the slow scanning direction and approximately symmetrical with respect to the central line. And the single first driven roller 73 is positioned most downstream in the slow scanning direction and on the central line.

There are elastic members (not shown) adapted to urge the second driven rollers 71*a*, 71*b*, 72*a*, 72*b*, and 73, respectively, against the second transport roller 5. Like the springs 9 as described earlier, five elastic members are provided correspondingly to the second driven rollers 71*a*, 71*b*, 72*a*, 72*b*, and 73. Alternatively, three elastic members may be provided, one for each of the pair of second driven rollers 71 (71*a*, 71*b*), the pair of second driven rollers 72 (72*a*, 72*b*), and the single second driven roller 73. In either alternative, the second driven rollers 71*a* and 71*b* are urged at equal forces, and so are the pair of second driven rollers 72*a* and 72*b*.

The sheet 10 is transported in a sequence as described below. The sheet 10 is transported by the first transport roller 4 and the first driven rollers A to C in such a manner that a beginning end of image forming region of the sheet 10 enters the image forming area where the inkjet print head 2 forms an image on the sheet 10. The sheet 10 is then transported a predetermined distance, so that a leading end thereof is nipped between the second transport roller 5 and the second driven rollers 72*a* and 72*b*. At the moment, the sheet 10 as pressed by the second driven rollers 72*a* and 72*b* undergoes a change in load thereon, although the change is comparatively small.

Then, the leading end of the sheet 10 is nipped between the second transport roller 5 and the second driven rollers 71*a* and 71*b*. The rollers 71*a* and 71*b* are located at a distance L1 downstream from the rollers 72*a* and 72*b*. And finally, the leading end is nipped between the second transport roller 5 and the second driven roller 73. The roller 73 is located at a distance L2 downstream from the rollers 72*a* and 72*b*.

Since the leading end is nipped sequentially in three steps between the rollers 71 to 73 and the roller 5, the sheet 10 undergoes a smaller change in load thereon than when the leading end is nipped at one time. The smaller change in load means less negative effect on the transport precision of sheet 10, and thus less improper image formation.

In the meanwhile, as the image forming process proceeds, a tailing end of the sheet 10 reaches the first nip areas. The first driven rollers A to C are positioned in the mentioned order from upstream to downstream along the slow scanning direction, with a distance Y1 between the rollers A and B and a distance Y2 between the rollers B and C. The rollers A to C are supported rotatably about the support shaft 81. The rollers A to C are urged against the first transport roller 4 by the springs 9. As shown in FIG. 1, further the rollers A to C are disposed along the fast scanning direction, with the pair of rollers A1 and A2 and the pair of rollers B1 and B2 arranged symmetrically with respect to the roller C.

As the image forming process proceeds on, the arrangement causes the tailing end first to be released from the nip areas between the rollers A1 and A2 and the roller 4 while held in the respective nip areas between the rollers B1 and B2 and the roller 4 and between the roller C and the roller 4. Next, the tailing end is released from the nip areas between the rollers B1 and B2 and the roller 4, while held in the nip area between the roller C and the roller 4. Finally, when the tailing end is released from the nip area between the roller C and the roller 4, the sheet 10 is transported in the slow scanning direction only by the second transport roller 5 and the second driven rollers 71 and 73.

The image forming process still continues until a not shown sheet sensor outputs a signal of detection of the tailing end, based on which it is determined that an image is formed up to a terminal end of image forming region of the sheet 10 (the terminal end is set to approximately 3 mm from the tailing end in the present embodiment).

Since pressure on the tailing end is reduced sequentially in three steps, the sheet 10 undergoes a gradual change in load thereon in the process of the tailing end being released from the nip areas. The gradual load change prevents abrupt fluctuations in precision of sheet transport, thereby ensuring that preferable image quality is maintained.

As described earlier, the holders 8*a* to 8*e*, which are provided for supporting the first driven rollers A to C individually rotatably and are aligned with one another along the fast scanning direction, are assembled, through the support shaft 81, into the holder assembly 8. The pre-assembled design of holder assembly 8 allows precise arrangement of the first driven rollers A to C along the slow scanning direction. Also, the pre-assembled design results in reduced number of components, and thus in reduced costs and facilitated assembly work.

The five springs 9 are provided along the fast scanning direction, correspondingly to the first driven rollers A1, A2, B1, B2, and C in order to urge the respective rollers against the first transport roller 4. Since the holders 8*a* to 8*e* are connected only through the shaft 81, the springs 9 independently apply pressures to the corresponding rollers A1 to C. Accordingly, the springs 9 can be adapted to apply different pressures on the corresponding rollers A1 to C. Further, the rollers A to C can be pressed at different forces against the first transport roller 4, in order further to reduce a change in load on the sheet 10 at the moment the leading end of the sheet 10 is held in the second nip areas. Similarly, the second driven rollers 71 to 73 can be pressed at different forces against the second transport roller 5, in order further to reduce a change in load on the sheet 10 at the moment the tailing end of the sheet 10 is released from the first nip areas.

Specifically, the pair of rollers B, positioned downstream of the pair of rollers A in the sheet transport direction, applies to the roller 4 a total pressure lower than that of the pair of rollers A. The single roller C, positioned more downstream of the pair of rollers B, applies to the roller 4 a pressure lower than the total pressure of the pair of rollers B. More specifically, respective pressures PA, PB, and PC that the rollers A, B, and C apply to the roller 4 are set to satisfy the following inequality: 2 PA>2 PB>PC.

On the other hand, the pair of rollers 72, which are positioned most upstream of the rollers 71 to 73 in the sheet transport direction, applies the lowest total pressure to the roller 5. For example, respective pressures P71, P72, and P73 that the rollers 71, 72, and 73 apply to the roller 5 are set to satisfy the following inequality: 2 P72<2 P71<P73.

It is to be noted that the first driven rollers A to C and the second driven rollers 71 to 73 may be arranged otherwise than as described in the embodiments and that the number of the rollers A to C and 71 to 73 may be increased or decreased.

The invention claimed is:

1. An inkjet printer comprising:

a first transport roller driven in a direction for transporting a sheet;

a plurality of first driven rollers configured to press a sheet against the first transport roller in such a manner that the sheet is nipped between the first driven rollers and the first transport roller;

a second transport roller driven in the direction, the second transport roller being positioned downstream of the first transport roller in a sheet transporting direction;

a plurality of second driven rollers configured to press a sheet against the second transport roller in such a manner that the sheet is nipped between the second driven rollers and the second transport roller;

an inkjet print head configured to eject ink drops on a sheet while being reciprocated along a perpendicular direction to the sheet transporting direction, the inkjet print head being positioned between the first transport roller and the second transport roller; and a holder assembly including:

a plurality of holders for mounting the respective first driven rollers in such a manner that the first driven rollers are supported individually rotatably at different locations along the perpendicular direction while being arranged in different groups of one or more on different lines parallel to the perpendicular direction;

a support for supporting the holders; and a plurality of urging members for urging the respective first driven rollers against the first transport roller through the respective holders, wherein the urging members are configured to urge a more downstream one of the groups in the sheet transporting direction against the first transport roller with a weaker total force.

2. The inkjet printer according to claim 1, wherein the second driven rollers are arranged at different locations along the sheet transporting direction, and more than one of the second driven rollers are arranged most upstream in the sheet transport direction and in alignment with one another along the perpendicular direction.

3. The inkjet printer according to claim 2, wherein the most upstream second driven rollers are urged against the second transport roller with weakest total force.

4. The inkjet printer according to claim 1, wherein the plurality of first driven rollers includes, at least one first urging roller positioned most upstream with respect to the direction for transporting the sheet, at least one second urging roller positioned downstream with respect to the at least one first urging rollers, and a third urging roller positioned downstream with respect to the at least one second urging rollers, wherein, a pressure PA that the at least one first urging roller applies to the first transport roller, a pressure PB that the at least one second urging roller applies to the first transport roller, and a pressure PC that the third urging roller apply to the first transport roller have the following relationship:

$$2PA>2PB>PC.$$

5. The inkjet printer according to claim 1, wherein the plurality of second driven rollers includes, at least one first urging roller positioned most upstream with respect to the direction for transporting the sheet, at least one second urging roller positioned downstream with respect to the at least one first urging rollers, and a third urging roller positioned downstream with respect to the at least one second urging rollers, wherein, a pressure PA' that the at least one first urging roller applies to the first transport roller, a pressure PB' that the at least one second urging roller applies to the first transport roller, and a pressure PC' that the third urging roller apply to the first transport roller have the following relationship:

$$2PA'<2PB'<PC'.$$

* * * * *